US006520152B1

(12) United States Patent
Mahr et al.

(10) Patent No.: US 6,520,152 B1
(45) Date of Patent: Feb. 18, 2003

(54) FUEL INJECTION SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 11 days.

(21) Appl. No.: 09/830,014

(22) PCT Filed: Aug. 2, 2000

(86) PCT No.: PCT/DE00/02553

§ 371 (c)(1),
(2), (4) Date: Jun. 4, 2001

(87) PCT Pub. No.: WO01/14737

PCT Pub. Date: Mar. 1, 2001

(30) Foreign Application Priority Data

Aug. 20, 1999 (DE) ..... 199 39 418

(51) Int. Cl.[7] ..... F02M 63/02
(52) U.S. Cl. ..... 123/447; 123/446; 123/467
(58) Field of Search ..... 123/446, 447, 123/456, 467

(56) References Cited

U.S. PATENT DOCUMENTS

| | | | | | |
|---|---|---|---|---|---|
| 4,712,528 | A | * | 12/1987 | Schaffitz | 123/446 |
| 5,642,714 | A | * | 7/1997 | Buckley | 123/447 |
| 5,711,274 | A | * | 1/1998 | Drummer | 123/456 |
| 5,732,679 | A | * | 3/1998 | Takahashi et al. | 123/467 |
| 6,112,721 | A | * | 9/2000 | Kouketsu et al. | 123/447 |

FOREIGN PATENT DOCUMENTS

| | | | | |
|---|---|---|---|---|
| JP | 6-93936 | * | 4/1994 | 123/447 |

* cited by examiner

*Primary Examiner*—Tony M. Argenbright
(74) *Attorney, Agent, or Firm*—Ronald E. Greigg

(57) ABSTRACT

In a fuel injection system for an internal combustion engine, in which fuel can be injected at least two different, high fuel pressures, via injectors, into the combustion chamber of the engine, having a central first pressure reservoir for the higher fuel pressure and a central second pressure reservoir, supplied from the first pressure reservoir, in which by regulation of its fuel delivery, the lower fuel pressure is maintained, and having a valve unit for switchover between the higher and the lower fuel, the valve unit for switchover between the higher and the lower fuel is provided locally for each injector. With this injection system, improved metering of the lower fuel pressure is possible.

3 Claims, 7 Drawing Sheets

FUEL INJECTION SYSTEM FOR AN INTERNAL COMBUSTION ENGINE

CROSS-REFERENCE TO RELATED APPLICATIONS

Figure 1A:
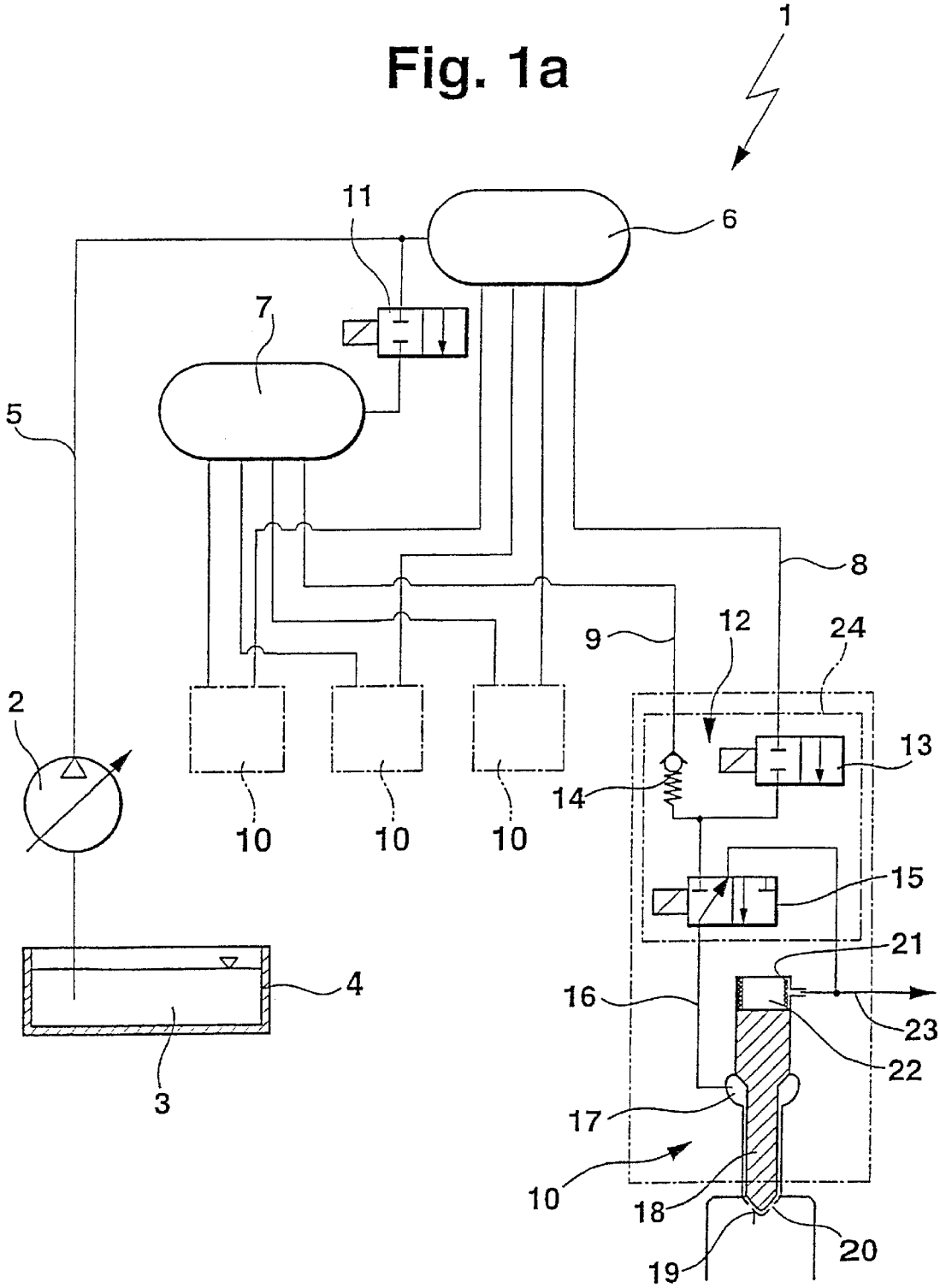

This application is a 35 USC 371 application of PCT/DE 00/02553 filed on Aug. 2, 2000.

BACKGROUND OF THE INVENTION

FIELD OF THE INVENTION

The invention is based on fuel injection system for an internal combustion engine and more particularly to such a fuel injection system capable of injecting fuel at at least two different pressures.

DESCRIPTION OF THE PRIOR ART

One injection system of the type with which this invention is concerned has been disclosed by European Patent Disclosure EP 0 711 914 A1.

For better comprehension of the ensuing description, several terms will first be defined in more detail: In a pressure-controlled fuel injection system, a valve body (such as a nozzle needle) is opened counter to the action of a closing force by the fuel pressure prevailing in the nozzle chamber of an injector, and thus the injection opening is uncovered for an injection of the fuel. The pressure at which fuel emerges from the nozzle chamber into the cylinder is called the injection pressure. The term stroke-controlled fuel injection system is understood in the context of the invention to mean that the opening and closing of the injection opening of an injector takes place with the aid of a displaceable valve member on the basis of the hydraulic cooperation of the fuel pressures in a nozzle chamber and in a control chamber. An arrangement is furthermore described below as central when it is provided jointly for all the cylinders, and as local if it is intended for only a single cylinder.

In the pressure-controlled fuel injection system known from EP 0 711 914 A1, with the aid of a high-pressure pump, fuel is compressed to a first, high fuel pressure of about 1200 bar and stored in a first pressure reservoir. The fuel that is at high pressure is also pumped into a second pressure reservoir, in which by regulation of its fuel delivery using a 2/2-way valve, a second high fuel pressure of about 400 bar is maintained. Via a central valve control unit and a central distributor device, either the lower or the higher fuel pressure is carried into the nozzle chamber of an injector. There, by means of the pressure, a spring-loaded valve body is lifted from its valve seat, so that fuel can emerge from the nozzle chamber.

In this known fuel injection system, the fuel for an injection from the applicable central pressure reservoir is split via the central valve unit and the central distributor device to the individual injectors. The maximum possible injection window in each case is determined jointly by the valve unit and the distributor device.

From International Patent Disclosure WO98/09068, a stroke-controlled injection system is also known in which once again two pressure reservoirs for storing the two fuel pressures are provided. Once again, the metering of the applicable fuel pressure takes place via central valve units.

SUMMARY OF THE INVENTION

According to the invention in order to achieve improved metering of the lower fuel pressure, it is proposed that the lower fuel pressure be controlled not centrally but rather locally for each injector, via a valve unit. Because of the short line between a local valve unit and the nozzle chamber of the injector, line losses are reduced to a minimum. In addition to the better metering capability, further advantages reside in the ability to accurately replicate the pre- and post-injection at the lower fuel pressure, as well as a reduced influence of component tolerances on the pre- and post-injection events.

Figure 1B:
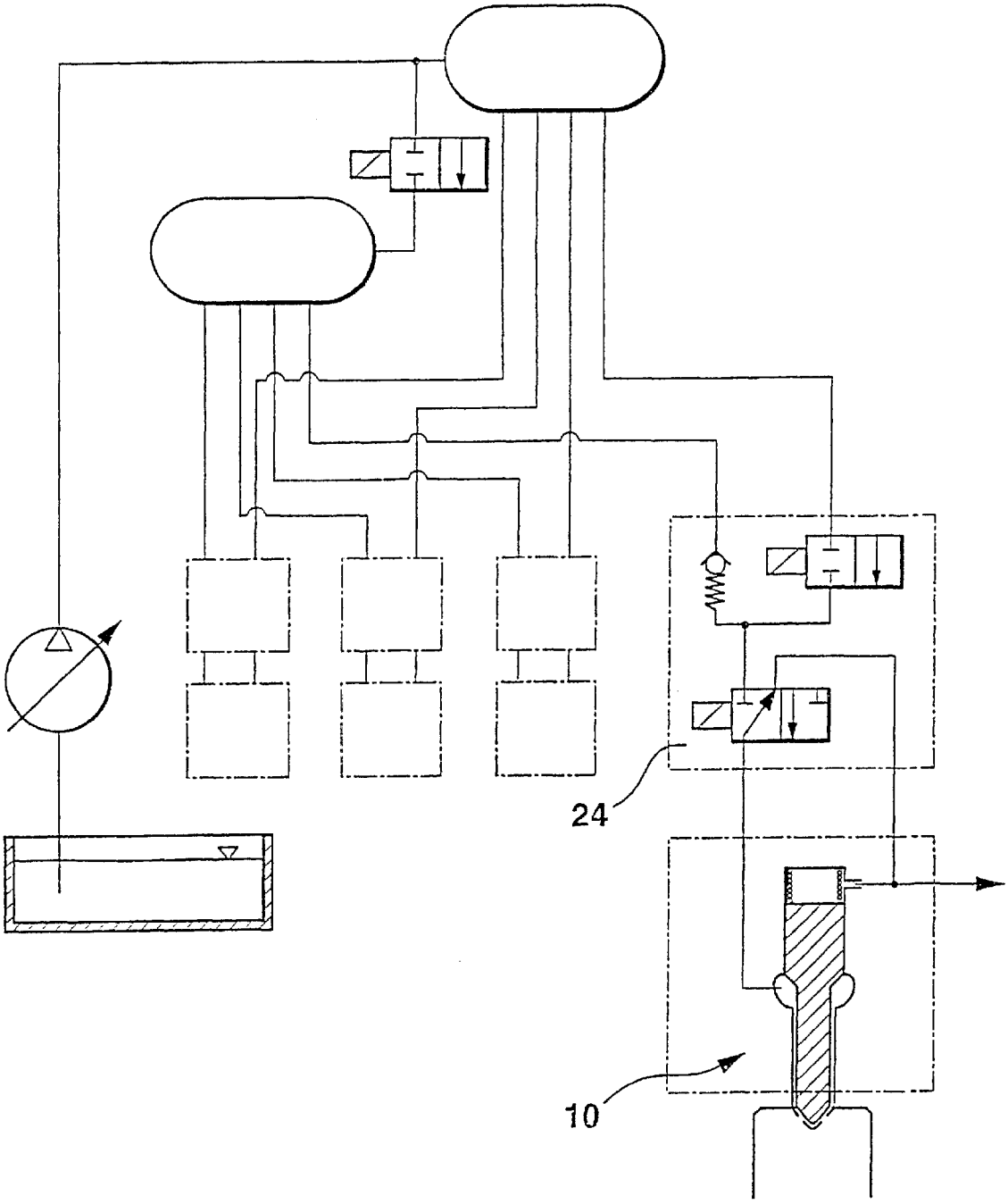
Figure 2A:
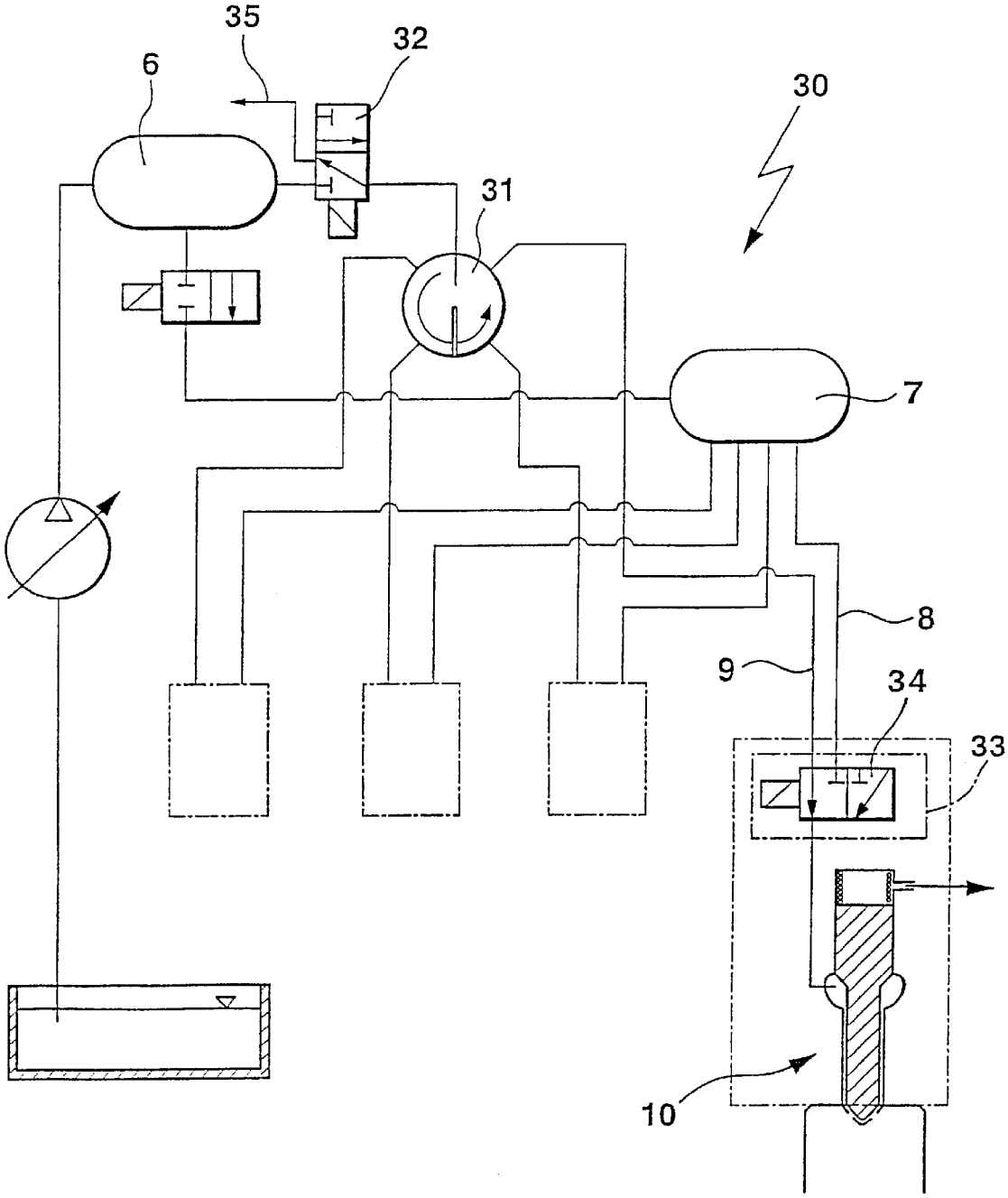
Figure 2B:
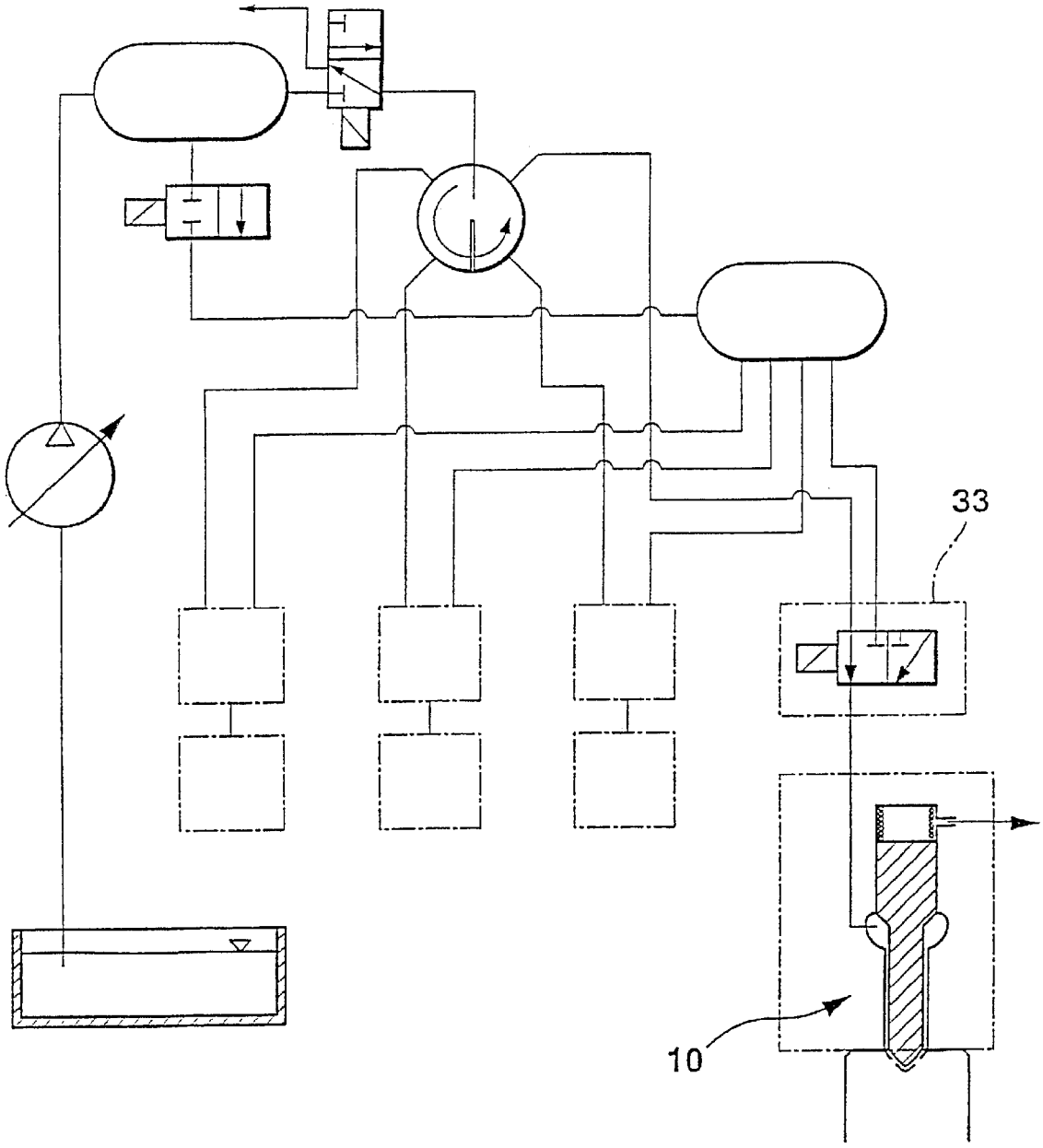
Figure 3A:
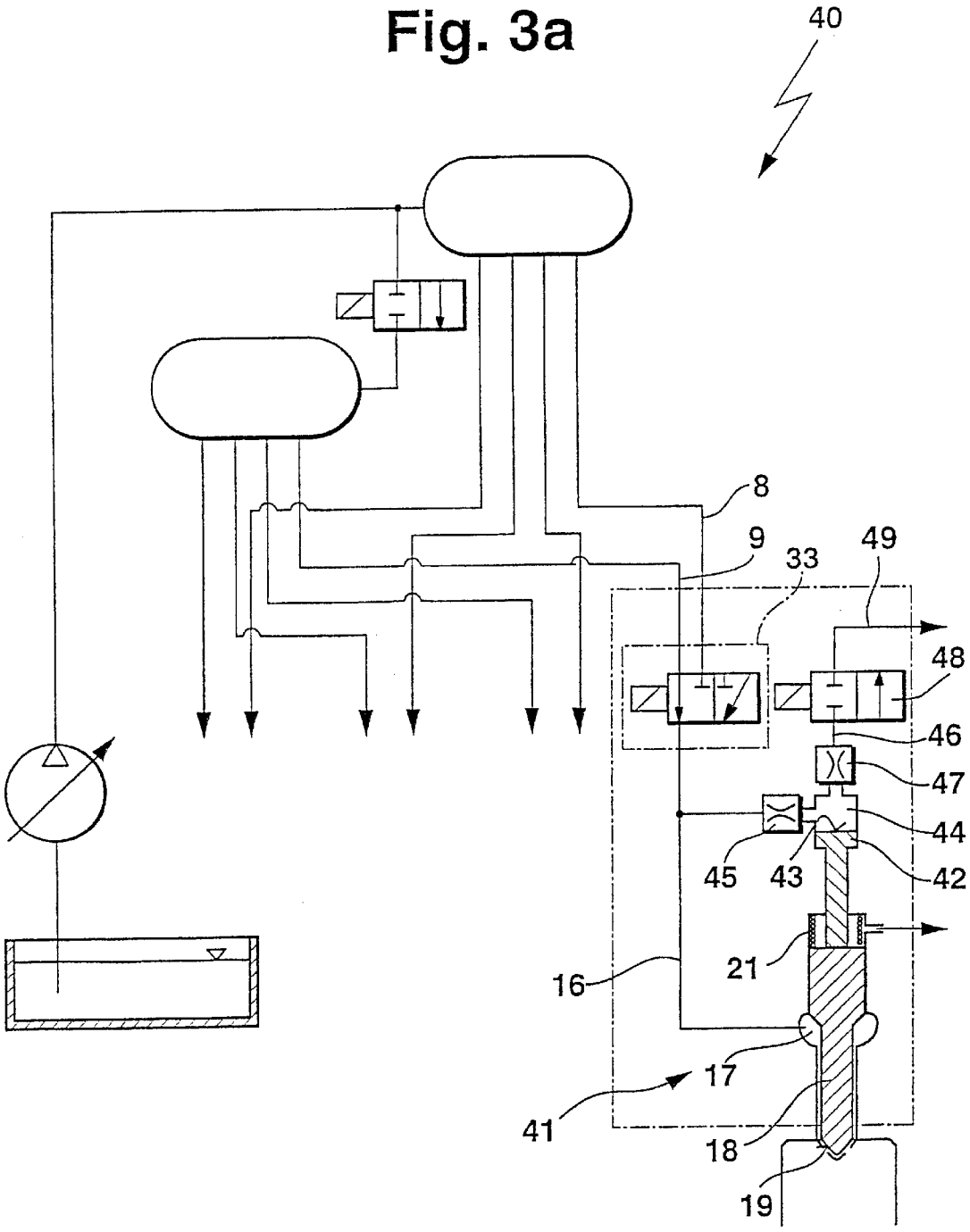
Figure 3B:
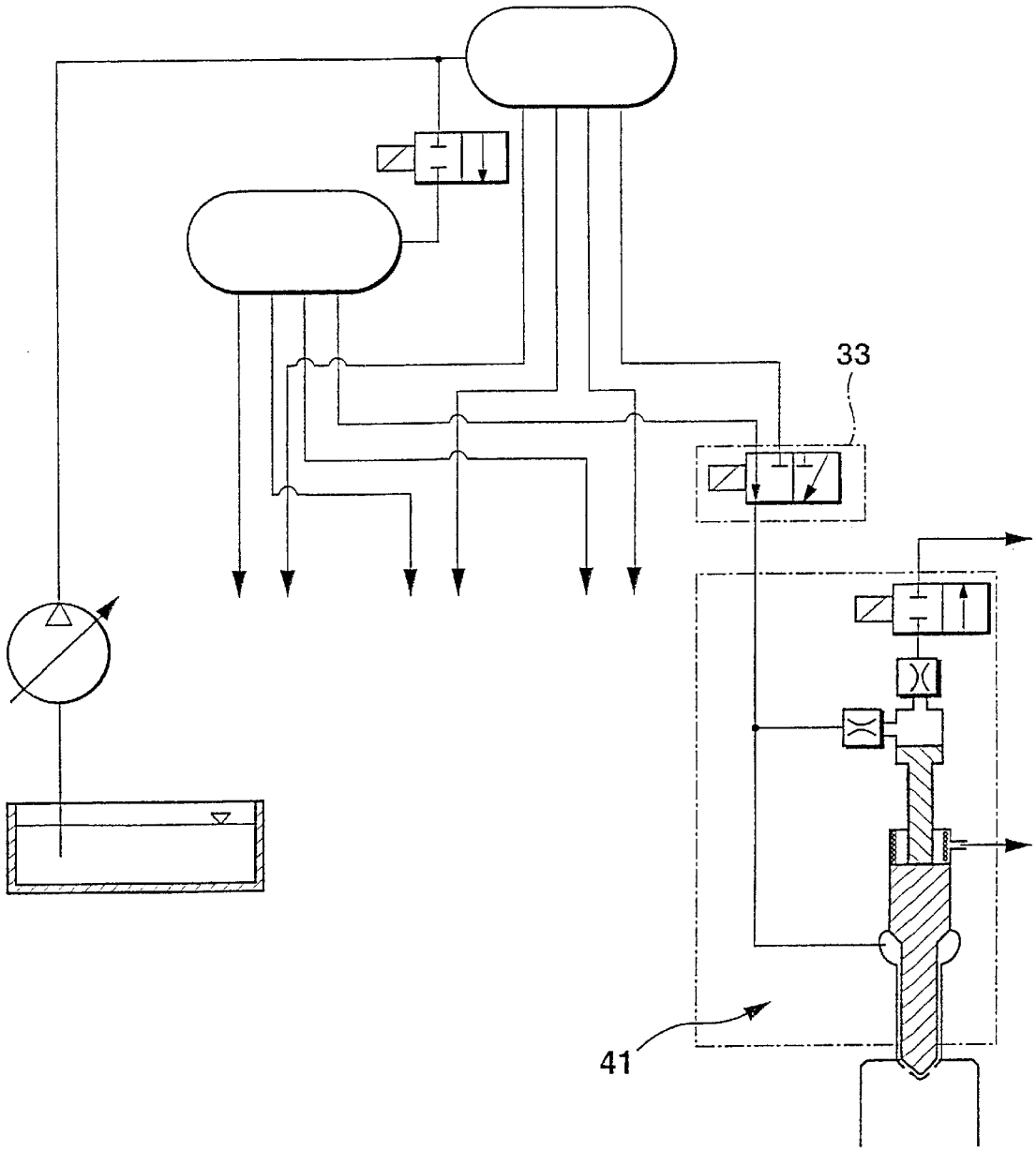
Figure 4:
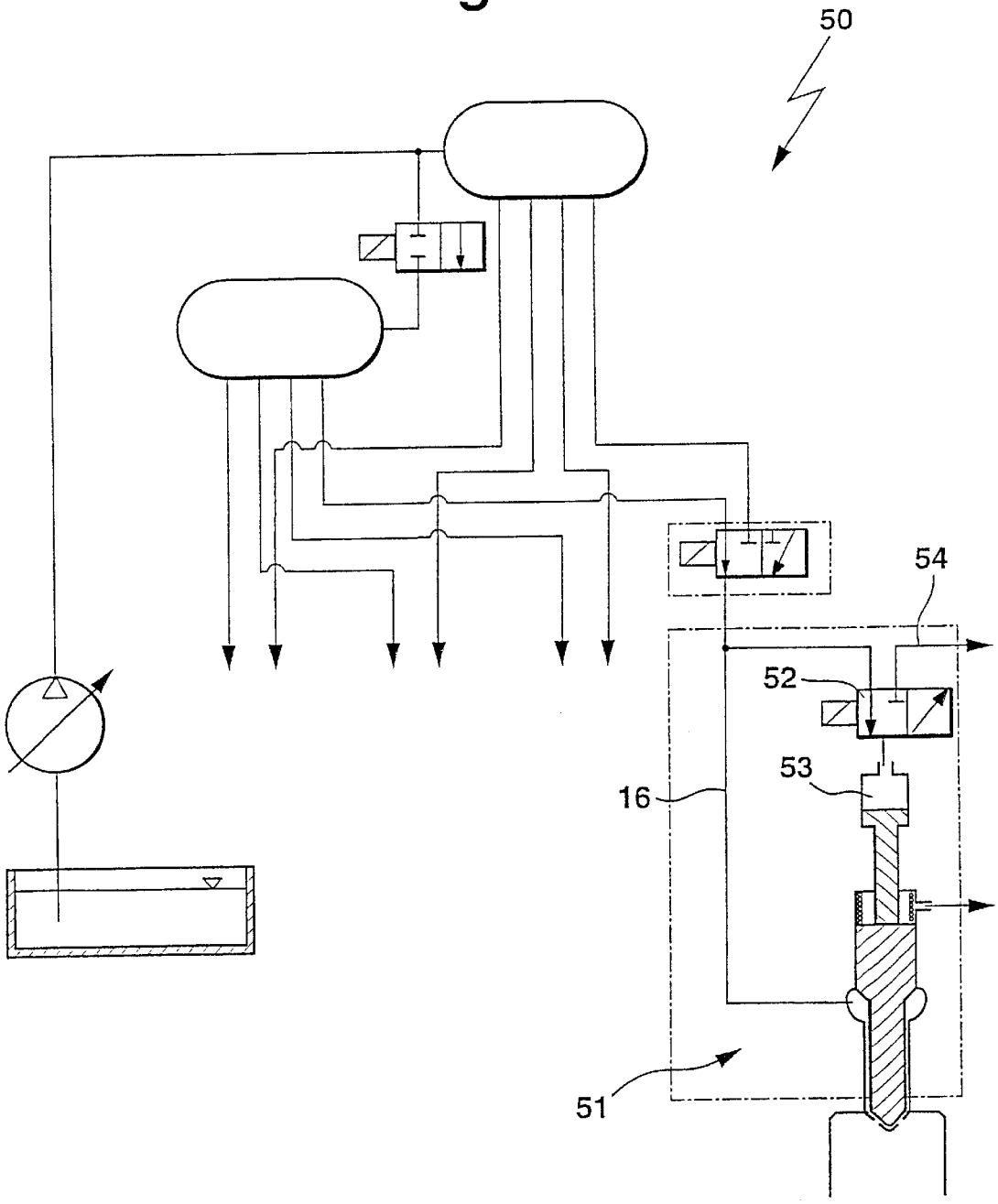

Further advantages and advantageous features of the subject of the invention can be learned from the description, drawing and claims contained herein below, taken with the drawings in which:

FIGS. 1*a* and 1*b* schematically illustrate a first injection system with pressure-controlled injectors and a local valve unit for switchover between the higher and the lower fuel pressure;

FIGS. 2*a* and 2*b* schematically illustrate a second injection system with pressure-controlled injectors and a modified local unit;

FIGS. 3*a* and 3*b* schematically illustrate a third injection system with stroke-controlled injectors and with the local valve unit shown in FIG. 2; and FIG. 4, schematically illustrates a fourth injection system with modified stroke-controlled injectors and with the local valve unit shown in FIG. 2.

DESCRIPTION OF THE PREFERRED EMBODIMENTS

In the first exemplary embodiment, shown in FIGS. 1*a* and 1*b*, of a pressure-controlled fuel injection system 1, a quantity-regulated fuel pump 2 pumps fuel 3 at a pressure of about 300 to 1800 bar out of a tank 4 via a supply line 5 into a first central pressure reservoir 6 (common rail) and into a second central pressure reservoir 7 (common rail), from each of which a plurality of pressure lines 8 and 9, corresponding to the number of individual cylinders, lead away to the individual pressure-controlled injectors 10 (injection devices) that protrude into the combustion chamber of the internal combustion engine to be supplied. Only one of the injectors 10 is shown in detail in FIG. 1.

With the aid of the fuel pump, a first, higher fuel pressure of up to 1800 bar is thus generated, which is stored in the first pressure reservoir 6. The fuel at this pressure is also pumped into the second pressure reservoir 6, in which by regulation of its fuel delivery by means of a 2/2-way valve 11, a second, lower fuel pressure of about 300 bar is maintained. One closed-loop control circuit with a pressure sensor is provided for each of the two pressure reservoirs 6, 7. The lower pressure level can be used for a pre-injection and as needed for a post-injection as well (hydrocarbon enrichment for exhaust gas post-treatment), while a main injection with the higher pressure fuel is done from the high-pressure reservoir 6.

The switchover from either the lower or the higher fuel pressure is done separately for each cylinder or injector 10, specifically via a respective local valve assembly 12, which has a 2/2-way valve 13 as a switch element for the higher fuel pressure in the pressure line 8. The outlet of this valve is decoupled from the pressure line 9 by a check valve 14. Via a 3/2-way valve 15, the applicable prevailing pressure is then carried via a pressure line 16 into a nozzle chamber 17 of the injector 10. The injection takes place under pressure control with the aid of a pistonlike valve member 18 (nozzle needle), which is axially displaceable in a guide bore and whose conical valve sealing face 19 cooperates with a valve seat face on the injector housing and thus closes the injection openings 20 provided there. Inside the nozzle chamber 17, a pressure face of the valve member 18, pointing in the opening direction of the valve member 18, is exposed to the pressure prevailing there; via an annular gap between the valve member 18 and the guide bore, the nozzle chamber 17 is extended as far as the valve sealing face 19 of the injector 10. By means of the pressure prevailing in the nozzle chamber 17, the valve member 18 that seals off the injection openings 20 is opened counter to the action of a closing force (closing spring 21), and the spring chamber 22 is relieved by means of a leakage line 23.

The injection at the lower fuel pressure takes place, with no current being supplied to the 2/2-way valve 13, by supplying electrical current to the 3/2-way valve 15. The injection at the higher fuel pressure takes place with current supplied to the 3/2-way valve 15 by means of supplying current to the 2/2-way valve 13; the check valve 14 prevents an unintentional return to the pressure line 9. At the end of injection, with no current supplied to the 2/2-way valve 13, the 3/2-way valve 15 is switched back to leakage 23. As a result, the pressure line 16 and the nozzle chamber 17 are pressure-relieved, so that the spring-loaded valve member 18 closes the injection openings 20 again.

The arrangement identified overall by reference numeral 24 in FIG. 1*a* and comprising the local valve assembly 12 and the 3/2-way valve 15 can be disposed either inside the injector housing (FIG. 1*a*) or outside the injector housing (FIG. 1*b*), for instance in the region of the pressure reservoirs 6, 11. In this way, a smaller size of the injector housing can be achieved, and by utilizing wave reflections in what is now a longer pressure line 16, an increased injection pressure is attainable.

In the description below of the other drawings, only the differences from the fuel injection system of FIGS. 1*a* and 1*b* will be addressed. Identical or functionally identical components are identified by the same reference numerals and will not be described again in detail.

Unlike the injection system 1, in the injection system 30 shown in FIG. 2*a*, the higher fuel pressure of the first pressure reservoir 6 is split centrally to the individual injectors 10 via a distributor device 31. The metering of the fuel stored in the first pressure reservoir 6 is controlled centrally by a 3/2-way valve 32 upstream of the distributor device 31. The switchover between the two pressure lines 8, 9 is effected locally for each injector 10 via the valve assembly, identified overall by reference numeral 33, in which a 3/2-way valve 34 is provided as a switch element. The injection at the lower fuel pressure takes place with a currentless 3/2-way valve 32 by supplying current to the 3/2-way valve 34, while the injection at the higher fuel pressure takes place with current supplied to the 3/2-way valve 32 and with a currentless 3/2-way valve 34. At the end of this injection, with the 3/2-way valve 34 currentless, the 3/2-way valve 32 is switched back to leakage 35, as a result of which the distributor device 31 and the injector 10 are pressure-relieved. The local valve unit 33 can be disposed either inside the injector housing (FIG. 2*a*) or outside it (FIG. 2*b*).

The injection system 40 of FIG. 3*a* is distinguished from the injection system 1 by the use of the local valve assembly 33 and the use of stroke-controlled injectors 41, only one of which is shown in detail. Beginning with the pressure-controlled injector 10 of FIG. 1, in a stroke-controlled injector 41 the valve member 18 is engaged, coaxially with the valve spring 21, by a pressure piece 42, which with its face end 43 remote from the valve sealing face 19 defines a control chamber 44. From the pressure line 16, the control chamber 44 has a fuel inlet with a first throttle 45 and a fuel outlet to a pressure relief line 46 having a second throttle 47, which is controllable to leakage line 49 by means of a 2/2-way valve 48. Via the pressure in the control chamber 44, the pressure piece 42 is urged in the closing direction. Fuel at the first or second fuel pressure constantly fills the nozzle chamber 17 and the control chamber 44. Upon actuation (opening) of the 2/2-way valve 48, the pressure in the control chamber 44 can be reduced, so that as a consequence the pressure force in the nozzle chamber 17 exerted in the opening direction on the valve member 18 exceeds the pressure force exerted on the valve member 18 in the closing direction. The valve sealing face 19 lifts from the valve seat face, and fuel is injected. The process of pressure relief of the control chamber 44 and thus the stroke control of the valve member 18 can be varied by way of the dimensioning of the two throttles 45 and 47. The end of injection is initiated by re-actuation (closure) of the 2/2-way valve 48, which decouples the control chamber 44 from the leakage line 49 again, so that a pressure that is capable of moving the pressure piece 42 in the closing direction is built up again in the control chamber 44. The switchover to the high pressure level is achieved for each injector by supplying electrical current to the valve assembly 33. After the termination of injection, the pressurized fuel in the injector can expand via the valve unit 33 into the low-pressure rail, so that given a suitable design, the valve unit 11 can be omitted. The valve assembly 33 can be disposed either inside the injector housing (FIG. 3*a*) or outside it (FIG. 3*b*).

Magnet actuators or piezoelectric final control elements with suitable temperature compensation and the requisite force or travel step-up can be used in the 3/2-way valves. Piezoelectric final control elements make faster valve switching times and better metering capability possible. Furthermore, if a piezoelectric final control element is used, then one or both throttles in the stroke-controlled injector can be dispensed with.

The injection system 50 (FIG. 4), otherwise corresponding to FIG. 3*b*, has modified stroke-controlled injectors 51, each with a respective piezoelectrically controlled 3/2-way valve 52. The control chamber 53 of each injector 51, as a volume that is switched via the 3/2-way valve 52, is filled from the pressure line 16 with only one supply line or relieved via the leakage line 54. For an injection with the fuel pressure prevailing at the time in the pressure line 16, the control chamber 53, which is at this same pressure, is relieved as a result of an electrical current being supplied to the 3/2-way valve 52, and the injection takes place under stroke control.

In a fuel injection system 1 for an internal combustion engine, in which fuel can be injected at least at two different, high fuel pressures, via injectors 10, into the combustion chamber of the engine, having a central first pressure reservoir 6 for the higher fuel pressure and a central second pressure reservoir 7, supplied from the first pressure reservoir 6, in which by regulation of its fuel delivery, the lower fuel pressure is maintained, and having a valve unit for switchover between the higher and the lower fuel, the valve unit 12 for switchover between the higher and the lower fuel is provided locally for each injector 10. With this injection system, improved metering of the lower fuel pressure is possible.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system (1; 30; 40; 50) for an internal combustion engine, in which fuel can be injected at at least two different, high fuel pressures, via injectors (10; 41; 51), into the combustion chamber of the engine, having a central pressure reservoir (6) for the higher fuel pressure and a central second pressure reservoir (7), supplied from the first pressure reservoir (6), in which by regulation of its fuel delivery, the lower fuel pressure is maintained, and having a valve unit for switchover between the higher and lower fuel, the improvement wherein;

the valve unit (12; 33) for switchover between the higher and lower fuel pressure is provided locally for each injector (10; 41; 51), with the local valve unit (33) having a 3/2 way valve (34) as a switch element between the higher and lower fuel pressures, and wherein by means of the valve unit (12; 33) the nozzle chamber (17) and the control chamber (44) can be acted upon in common with either the low or the high fuel pressure.

2. The fuel injection system of claim 1, wherein the injectors (10) are embodied for pressure control.

3. The fuel injection system of claim 1, wherein the injectors (41, 51) are embodied for stroke control.

* * * * *